United States Patent [19]

Matayoshi et al.

[11] Patent Number: 5,033,420

[45] Date of Patent: Jul. 23, 1991

[54] ROCKER ARM ARRANGEMENT FOR VARIABLE TIMING TYPE VALVE TRAIN

[75] Inventors: Yutaka Matayoshi, Yokosuka; Makoto Nakamura, Yokohama; Shigeru Sakuragi, Yokosuka, all of Japan

[73] Assignee: Nissan Motor Co., Ltd., Yokohama, Japan

[21] Appl. No.: 572,082

[22] Filed: Aug. 24, 1990

[30] Foreign Application Priority Data

Sep. 8, 1989 [JP] Japan ..... 1-233332

[51] Int. Cl.[5] ..... F01L 1/34

[52] U.S. Cl. ..... 123/90.16; 123/90.12

[58] Field of Search ..... 123/90.12, 90.15, 90.16, 123/90.17

[56] References Cited

U.S. PATENT DOCUMENTS

| | | | |
|---|---|---|---|
| 4,537,164 | 8/1985 | Ajiki et al. | 123/90.16 |
| 4,768,467 | 9/1988 | Yamada et al. | 123/90.16 |
| 4,829,948 | 5/1989 | Yoshida et al. | 123/90.16 |
| 4,957,076 | 9/1990 | Inoue et al. | 123/90.16 |

FOREIGN PATENT DOCUMENTS

| | | |
|---|---|---|
| 0267687A1 | 10/1987 | European Pat. Off. . |
| 0318303A1 | 11/1988 | European Pat. Off. . |
| 0361637A1 | 3/1989 | European Pat. Off. . |
| 2552820 | 10/1984 | France . |
| 1198606 | 8/1965 | German Democratic Rep. . |
| 2014575 | 10/1971 | German Democratic Rep. . |
| 63-57805 | 3/1988 | Japan . |
| 63-167016 | 7/1988 | Japan . |
| 1-80712(A) | 3/1989 | Japan . |
| 2185784A | 1/1987 | United Kingdom . |
| 2199079A | 12/1987 | United Kingdom . |

*Primary Examiner*—E. Rollins Cross
*Assistant Examiner*—Weilun Lo
*Attorney, Agent, or Firm*—Foley & Lardner

[57] ABSTRACT

Main and sub-rocker arms mounted on a common shaft and pivotally supported on a cylinder head by a pivot formed at the end of an adjust screw which is provided at one of the main rocker arm. The main and sub-rocker arms are motivated by cams suited for low engine speed and high engine speed operation respectively. A hydraulically operated interlocking device which selectively locks the main and sub-rocker arms together, is controlled by a supply of hydraulic fluid by way of a passage structure formed in the adjust screw and a pivot seat in which the pivot is received.

8 Claims, 4 Drawing Sheets

ROCKER ARM ARRANGEMENT FOR VARIABLE TIMING TYPE VALVE TRAIN

BACKGROUND OF THE INVENTION

1. Field of the Invention

The present invention relates generally to a variable valve timing arrangement for an internal combustion engine and more specifically to a rocker arm construction for such an arrangement.

2. Description of the Prior Art

JP-A-63-167016 and JP-A-63-57805 disclosed rocker arm arrangements which include a first rocker arm which is arranged to cooperate with a low speed cam and a second rocker arm which cooperates with a high speed cam. The two rocker arms pivotally mounted on a common rocker arm shaft.

A hydraulically operated connection device which enables the first and second rocker arms to be selectively locked together, comprises a set of plunger bores which are formed in the rocker arms in a manner to be parallel with and at a predetermined distance from the axis of the shaft about which the arms are commonly pivotal. By applying a hydraulic pressure to the end or ends of the plungers reciprocally disposed in the bores, the plungers can be induced to move axially within their bores and induce the situation wherein two of the plungers will partially enter an adjacent bore and lock the two arms together.

However, this arrangment has suffered from the drawbacks that at least one rocker arm shaft must be provided on the cylinder head to support the rocker arms in position. This of course consumes valuable space and increases the number of parts which must be disposed on the cylinder head. In addition as the rocker arms are actually supported by the rocker arm shaft, it is subject to relatively large moments of force and thus must be relatively robust and the cylinder head provided with suitable webs to facilitate suitable mounting of the same.

Further, as the axis about which the rocker arms are pivoted are fixed with the rocker arm shaft, it is necessary to provide adjust screws for adjusting the valve clearances at the valve engaging ends of the rocker arms. This provision increases the mass of the arms and therefore the moments produced by the same. This tends to reduce engine response at high engine speeds.

SUMMARY OF THE INVENTION

It is an object of the present invention to provide a rocker arm arrangement which can provide variable valve timing of the nature disclosed above and eliminates both the need for a rocker arm shaft and the use of adjust screws at the valve engaging ends of the rocker arms.

In brief, this object is achieved by an arrangement wherein main and sub-rocker arms mounted on a common shaft and pivotally supported on a cylinder head by a pivot formed at the end of an adjust screw which is provided at one of the main rocker arm. The main and sub-rocker arms are motivated by cams suited for low and high engine speed (and/or load) operation respectively. A hydraulically operated interlocking device which selectively locks the main and sub-rocker arms together is controlled by a supply of hydraulic fluid by way of a passage structure formed in the adjust screw and a pivot seat which is threaded into a bore formed in the cylinder head and in which the pivot at the end of the adjust screw, is received.

More specifically, a first aspect of the invention comes in the form of an internal combustion engine having a cylinder head and a poppet valve which is associated with the cylinder head and which features: a first rocker arm, the first rocker arm being arranged to engage a stem of the poppet valve and to engage a first cam having a profile suited for low speed engine operation; a second rocker arm, the second rocker arm being arranged to engage a second cam having a profile suited for high speed engine operation; a shaft on which the first and second rocker arms are pivotally mounted; hydraulically operated engagement means for selectively connecting the first and second rocker arms in a manner wherein relative movement therebetween is prevented; a pivot formed in the cylinder head, the cylinder head being formed with a supply passage structure through which hydraulic fluid under pressure can be selectively supplied and which leads to the pivot; an adjust screw which is threadedly engaged in a bore formed in the first rocker arm, the adjust screw having a base portion which engages the pivot; and passage means formed in the adjust screw for supplying hydraulic fluid from the supply passage structure to the hydraulically operated engagement means.

A second aspect of the present invention comes in the form of a valve train for an internal combustion engine which features: a first rocker arm, the first rocker arm being arranged to engage a poppet valve and to be motivated by a first cam having a profile suited for low speed engine operation; a second rocker arm, the second rocker arm being arranged to be motivated by a second cam having a profile suited for high speed engine operation; a shaft which the first and second rocker arms are mounted and about which the first and second rocker arms are pivotal; a hydraulically operated interlocking device which selectively interconnects the first and second rocker arms in a manner wherein relative movement therebetween is prevented; a pivot at one end of the first rocker arm, the pivot being received in a pivot seat which is adapted for connection with a cylinder head having a supply passage structure through which hydraulic fluid under pressure can be selectively supplied; and passage means for providing fluid communication between the supply passage and the interlocking device, the passage means comprising a first passage formed in the pivot seat and a second passage formed in the pivot.

DETAILED DESCRIPTION OF THE PRESENT INVENTION

Figure 1:
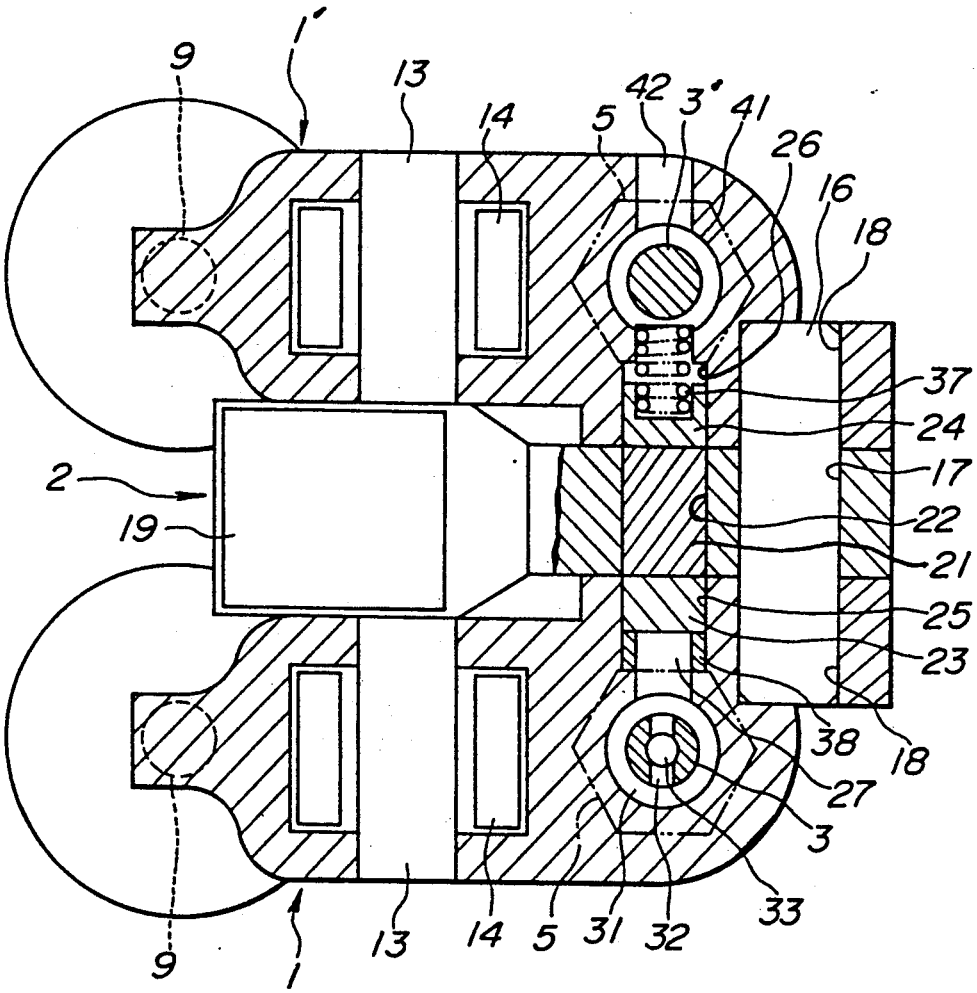
FIGS. 1 and 2 are sectional plan and elevation view showing a first embodiment of the present invention.
Figure 2:
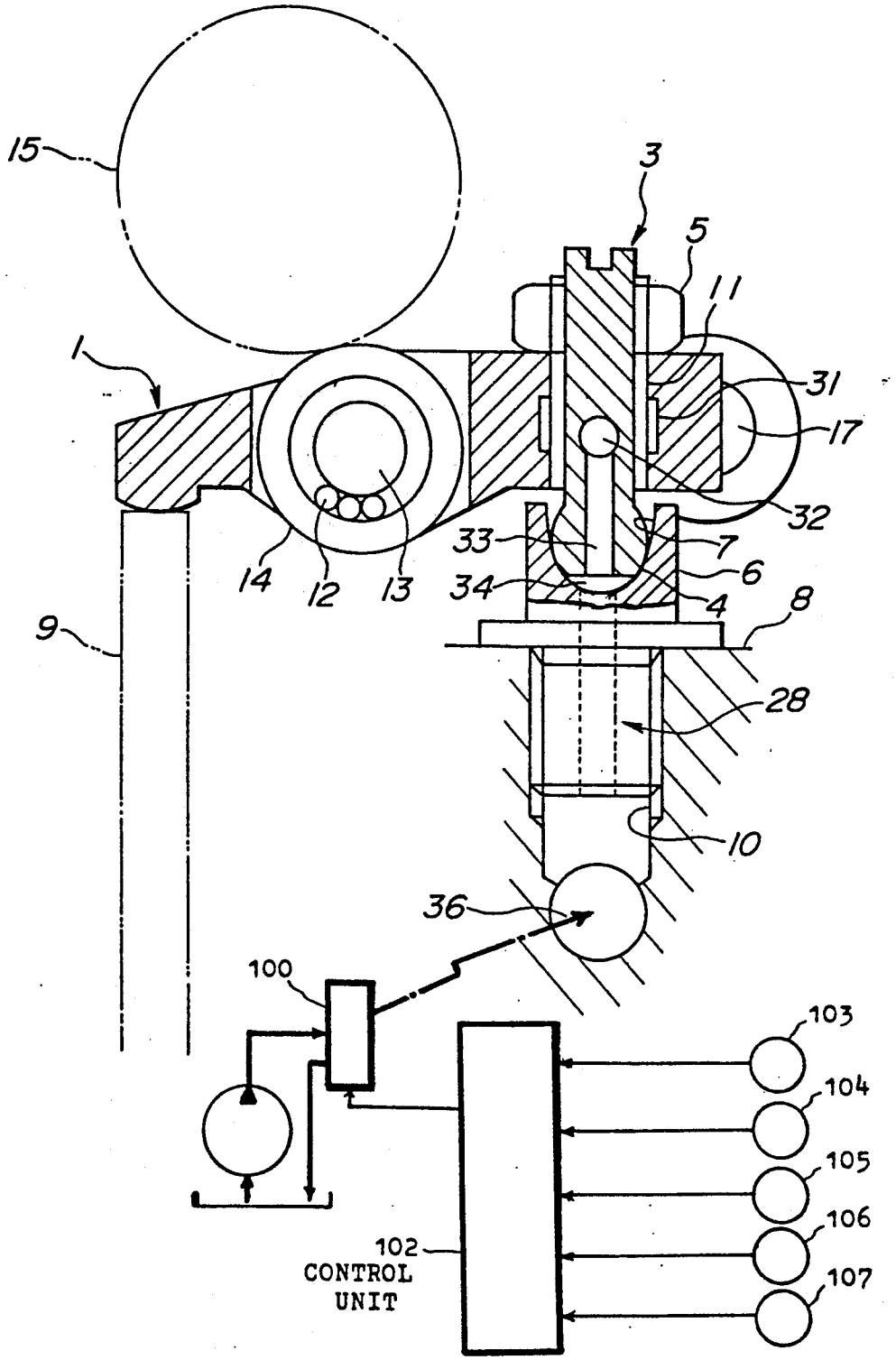

FIGS. 1 and 2 show a first embodiment of the present invention. In this arrangement first and second main rocker arms 1, 1' are arranged to engage to the tops of first and second poppet type valves 9 at one end thereof. The main rocker arms 1, 1' are each formed with a threaded bore 11 in which adjust screws 3, 3' are threadedly received. A lock nut 5 is threadedly received on an upper portion of each of the adjust screws 3, 3' in the illustrated manner. The lower ends of the adjust screws are formed spherical pivot members 4 which seat in a pivot seat 6. Each of the pivot seats 6 are threadedly received in a bore 10 formed in the cylinder head 8. As will be appreciated from FIG. 2 each pivot seat 6 is formed with a concavity or recess 7 which receives with the spherical pivot member 4 in a manner to define a universal joint. As will be appreciated from the drawings, the bottom of the recess has an essentially hemispherical shape.

Rollers 14 are rotatably supported in recessed portions of the main rocker arms by way of shafts 13 and needle bearings 12.

The rollers 14 are arranged to engage cams which have a profile suited for low engine speed and/or load operation. The base circle 15 of one of these cams is shown in phantom in FIG. 2. For simplicity these cams will be referred to as "low speed cams" hereinafter.

A sub-rocker arm 2 is pivotally connected to the main ones by way of a pivot shaft 16. This shaft 16 is arranged to pass through coaxially formed bores 18, 17 which are formed in the main and sub-rocker arms 1, 2 respectively.

The sub-rocker arm does not directly engage the poppet valves and is arranged to be subject to an upward bias (as seen in the drawings) by a single lost motion spring (not shown in FIGS. 1 and 2). A cam follower 19 formed on the upper side of the sub-rocker arm 2 is arranged to engage a cam which has a profile suited for high engine speed and/or load operation (referred to a high speed cam hereinafter). The lost motion spring is arranged to maintain the cam follower 19 in contact with the high speed cam.

A hydraulically operated interconnecting device is provided for enabling the main and sub-rocker arms to be locked together. This connection or interlocking device comprises: a plunger 21 which is reciprocatively disposed in bore 22 formed in the sub-rocker arm 2; and plungers 23 and 24 which are reciprocatively disposed in bores 25 and 26 formed in the main rocker arms, respectively.

Plunger 23 is arranged to define a hydraulic chamber 27 within the bore 25 while plunger 26 is arranged to engage a return spring 37.

The bores 22, 25 and 26 are arranged to extend in the same direction and at the same distance from the shaft 16 so that the bores can be aligned and so that when the hydraulic pressure prevailing in chamber 27 exceeds a predetermined limit and produces a bias which overcomes the spring 37, plunger 23 can be moved in a manner to partially project into the bore 22 and to push plunger 21 axially so as to in turn project partially into bore 25. The movement of plunger 21 into bore 26 of course pushes plunger 24 deeper into bore 26 compressing the return spring 37.

Under these conditions, the main and sub-rocker arms are interconnected in a manner to pivot in unison.

A spacer 38 is disposed in bore 25 in a manner to limit the movement of the plunger 23 away from the sub-rocker arm and thus prevent the three plungers from being moved under the influence of the spring 37 in a manner which permits plungers 22 and 24 to project partially into bores 22 and 25 respectively. As will be appreciated this measure is necessary in order to prevent undesired interlocking of the rocker arms when the pressure in the chamber 27 is reduced below the above mentioned predetermined limit.

In this embodiment, the bore 26 is fluidly communicated with an air hole 42 in a manner which vents the same to the surrounding atmosphere.

The bore 25 in which plunger 23 is disposed and in which hydraulic chamber 27 is defined, is fluidly communicated with an oil gallery 36 formed in the cylinder head 8, by way of a passage structure which comprises: a passage 28 which is formed through the pivot seat 6 and opens into the spherical recess 7; a coaxial bore 33 which is formed the lower half of the adjust screw 3; a radial extending bore 32 which intersects with the upper end of the axial bore 33; and an annular recess 31 which is formed in the threaded bore 11 and which communicates the hydraulic chamber 27. The radial bore 32 opens into this annular recess 31 under normal adjust screw settings.

The lower end of the spherical pivot member 4 is formed with a flat which defines a chamber 34 at the bottom of the spherical recess 7. This chamber allows the passages 28 and 33 to stay in constant communication irrespective of the angle the adjust screw 3 assumes with respect to the pivot seat 6.

The oil gallery 36 is communicated with a valve 100 which controls the supply of hydraulic fluid under pressure into the gallery 36. The valve 100 is controlled by a control unit 102 which is supplied with data from an engine speed sensor 103, an engine coolant temperature sensor 104, a lubrication oil temperature sensor 105, an induction pressure sensor which senses the pressure prevailing in the engine induction system downstream of the engine throttle valve 106, and a throttle valve position sensor 107.

In this embodiment, the high and low speed cams are formed integrally on the same cam shaft. In this instance the low speed cam can be designed to not only provide a lower amount of lift than the high speed one but also reduce and/or shift the time for which the valves 9 are opened.

OPERATION

When the engine operational parameters such as sensed by the sensors mentioned above, are such as to indicate the need for the valves 9 to be lifted by the low speed cams, the control valve 100 is conditioned to reduce the pressure prevailing in the oil gallery to a low level. As a result, the plungers 21, 23 and 24 remain in the positions illustrated in FIG. 1. Under these conditions as none of the plungers project into an adjacent bore, the main the sub-rocker arms 1, 2 remain a non-connected or non-interlocked state and therefore movable relative to one another. Thus, even though the sub-rocker 2 arm is being pivoted by the high speed cam, the lack of any connection with the main rocker arm prevents this motion being transmitted to the valves 9. Accordingly, the lifting of the valves 9 is determined by the low speed cams. During this mode of operation the sub-rocker arms is induced to pivot back and forth against the bias of the lost motion spring.

On the other hand, when it is required to have the valves 9 lifted by the high speed cams, the control valve 100 is switched to a state wherein a high level of hydraulic pressure is permitted to prevail in the oil gallery 36. This increased pressure is transmitted via the passages 28, 33, 32, 31 into the hydraulic chamber 27. When the cam followers 14 and 19 are engagement with the base circles of the high and low speed cams and the bores 22, 25 and 26 come into alignment, the bias produced by the pressure prevailing in the hydraulic chamber 27 overcomes the bias of the spring 37 and the plungers 21, 23 and 24 are moved upwardly (as seen in the drawings) in a manner wherein plungers 21 and 23 project partially into adjacent bores. This locks the two rocker arms 1, 2 together. Under these conditions the pivotal motion of the sub-rocker arm 2 (motivated by the high speed cam) which is greater than that induced in the main rocker arm 1 by the low speed cams, is transferred to the main arm, and the valves 9 are lifted by the high speed cam. As will be appreciated, the increased lift produced by the high speed cam moves the rollers 14 out of engagement with the low speed cams during the lifting operation.

When it is required to reduce the valve lift, the pressure in the oil gallery is lowered and the plungers permitted to return the positions illustrated in FIG. 1 under the influence of the spring 37.

MERITS

The use of end pivoted rocker arms reduces the amount limited cylinder head space which is consumed by the valve train, to be reduced, by eliminating the need for a rocker shaft, and permits a desirably large valve lift to be achieved. This latter mentioned feature improves the efficiency with which engine aspiration can be achieved.

The provision of the adjust screws 3, 3' at the pivoted ends of the main rocker arms 1 permits the clearance between the valve stems and the main rocker arms to suitably adjusted and thus enables a reduction in the amount of noise produced by the valve train.

As the adjust screws 3, 3' are integrally formed with the pivot members 4 and located at the pivoted end of the rocker arms, their mass does not increase the moment of the main rocker arms and thus improves engine response at high engine speeds.

As the pivots 4 formed at the end of adjust screws 3 and 3' and the surfaces formed in the pivot seats 6 which supports the adjust screws, are spherical, a good seal is produced between the passage 33 formed in the adjust screw 3 and the passage 28 formed in the corresponding pivot seat 6. This minimizes leakage of hydraulic fluid therebetween and improves the response of the interlocking plunger arrangement to the supply of fluid under pressure from the oil gallery.

The passage structure which fluidly communicates the oil gallery and the interlocking or interconnecting device eliminates the need for a separate lubricating passage and thus simplifies the construction of the cylinder head. If necesary the pivot seat 6 which receives the pivot formed on the end of adjust screw 3' can be formed with a passage similar to passage 28 and thus supply lubricating fluid to the interface defined between two surface from the oil gallery.

The rocker arms can be assembled as a unit and easily placed in position on the pivot seats in the cylinder head. In the event that only the inlet valve operated by the above described VVT (variable valve timing) arrangement, it is possible to readily replace the conventional rocker arm arrangements which operate the exhaust valves with VVT units. Further, the assembly of each rocker arm unit is relatively simple. Each of the plungers can be slipped into their respective bores and the three rocker arms then connected by insertion of the shaft 16 into bores 17 and 18. The ease with which the units can be assembled and the ease with which the units can be disposed on the cylinder head markedly reduces the amount of time and effort required to completely assemble the cylinder head.

SECOND EMBODIMENT

Figure 3:
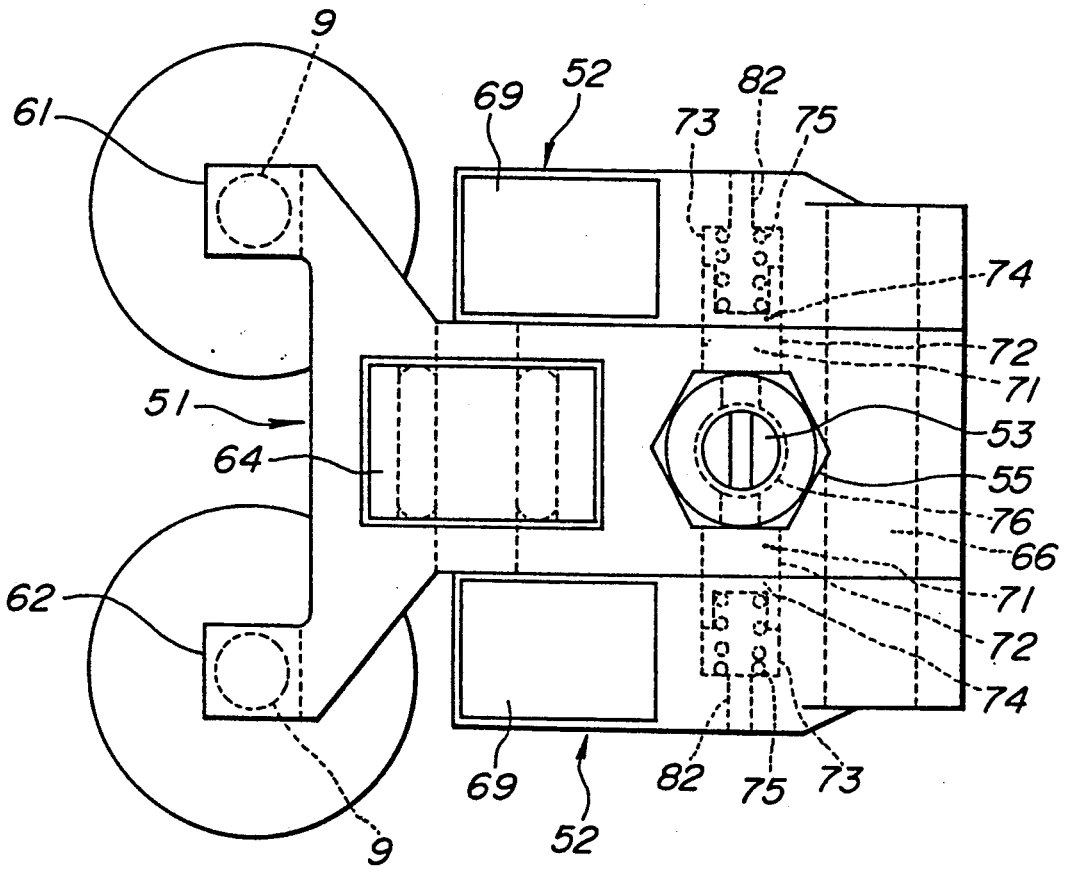
FIGS. 3 and 4 are sectional plan and elevation views showing a second embodiment of the present invention.
Figure 4:
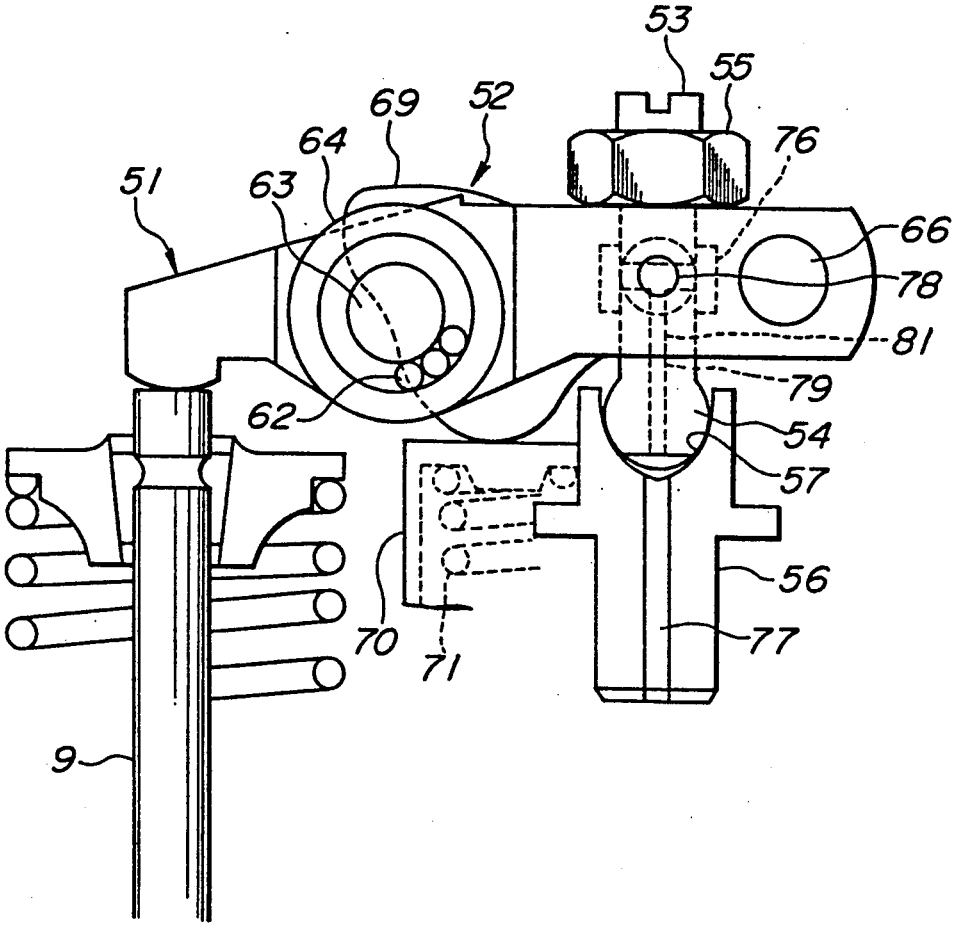

FIGS. 3 and 4 shows a second embodiment of the present invention. In this arrangement a single T-shaped bifurcate type main rocker arm 51 is arranged to lift both of the valves 9. On end of the rocker arm is formed with valve engaging portions 61, 62 while the other end is provided with a single adjust screw 53. A lock nut 55 is threadedly received on the upper portion of the adjust screw while a spherical pivot member 54 is formed on the lower portion.

A pivot seat 56 which is formed with a spherical recess 57 in which the spherically shaped pivot member 54 is received, is adapted to be threadedly received in a bore formed in the cylinder head (not shown in this figure).

A roller 64 is rotatably supported in a opening in the main rocker arm 51 by way of needle bearings 62 and a shaft 63. The roller 64 acts as a follower which engages a single low speed cam.

Two sub-rocker arms are disposed along either side of the main one. The three arms are pivotally connected by a shaft 66. Neither of the sub-rocker arms directly engages a valve stem and instead are formed with cam followers 69 which engage high speed cams, at their free ends.

The lower faces of the sub-rocker arms are formed with lobes (no numeral) which engage a return spring arrangement which is comprised of a return spring 71 and a spring retainer 70.

A hydraulically operated interlocking device for selectively interconnecting the three arms comprises: a pair of stepped diametrically opposed bores 72 which are formed in the main rocker arm and which reciprocatively receive plungers 71; a bore 73 formed in each of the sub-rocker arms 52; plungers 74 which are reciprocatively received in the inboard ends of the bores 73; and return springs 75 which are disposed between the ends of the plungers 74 and the bottoms of the bores 73.

The chambers which are defined in the bores 73 by the plungers 74 and in which the springs 75 are disposed are fluidly communicated with air passages 82.

The stepped bores 72 and the plungers 71 are dimensioned so that the inboard ends of the plungers abut the steps while outboard ends lie flush with the side faces of the main rocker arm. The smaller diameter portions of the stepped bores in combination with an annular groove 76 formed coaxially with the threaded bore in which the adjust screw 53 is received, define a hydraulic chamber.

The single adjust screw 53 is formed with a radial bore 78 which is arranged to communicate with the hydraulic chamber within the normal range of adjust screw adjustment. An axial passage 79 which leads from the radial bore 78 is formed in the lower portion of the adjust screw 53.

The construction of the passage and surfaces in the pivot seat 56 are the same as in the case of the first embodiment and hence further redundant disclosure will be omitted for brevity. It will be of course appreciated that the passage 77 formed in the pivot seat 56 fluidly communicates with an oil gallery of the nature disclosed in connection with the first embodiment.

OPERATION

During engine modes of operation wherein a small valve lift is required, the level of the hydraulic pressure which is supplied to the hydraulic chamber is maintained below a predetermined level. Under these conditions, the four plungers remain in the positions illustrated in FIG. 3, and the main and sub-rocker arms remain un-connected and pivotal relative to one another. Accordingly, even though both of the sub-rocker arms are being pivoted under the influence of the high speed cams, as no connection is established between with main rocker arm, the valves 9 are lifted in accordance with the pivoting induced in the main rocker arm by the engagement between the roller 64 and the low speed cam. During this time, the sub-rocker arms are pivoted only against the bias of the lost connection springs 71.

When higher lifting of the valves is required such as for high engine speed/load operation, the pressure in the hydraulic chamber is increased to a level whereat the bias of the return 75 is overcome. When the cam followers 64, 69 on the main and sub-rocker arms engage the base circle portions of the high and low speed cams and the bores 72 and 73 align, the plungers move out of the bores 72 to partially project into the bores 73 formed in the sub-rocker arms. This locks the three arms together. Following the interlocking the valve 9 are lifted under the control of the high speed cams which engage the cam followers 69 formed on the sub-rocker arms 52.

Although only two embodiments have been disclosed, it will be understood that a large number of variations and/or modifications can be made without departing from the scope of the present invention which is defined only by the appended claims.

What is claimed is:

1. In an internal combustion engine having a cylinder head and a poppet valve which is associated with said cylinder head:

a first rocker arm, said first rocker arm being arranged to engage a stem of the poppet valve and to engage a first cam having a profile suited for low speed engine operation;

a second rocker arm, said second rocker arm being arranged to engage a second cam having a profile suited for high speed engine operation;

a shaft on which said first and second rocker arms are pivotally mounted;

hydraulically operated engagement means for selectively connecting said first and second rocker arms in a manner wherein relative movement therebetween is prevented;

a pivot formed in the cylinder head, the cylinder head being formed with a supply passage structure through which hydraulic fluid under pressure can be selectively supplied and which leads to said pivot;

an adjust screw which is threadedly engaged in a bore formed in said first rocker arm, said adjust screw having a base portion which engages said pivot; and passage means formed in said adjust screw for supplying hydraulic fluid from the supply passage structure to said hydraulically operated engagement means.

2. In a valve train for an internal combustion engine:

a first rocker arm, said first rocker arm being arranged to engage a poppet valve and to be motivated by a first cam having a profile suited for low speed engine operation;

a second rocker arm, said second rocker arm being arranged to be motivated by a second cam having a profile suited for high speed engine operation;

a shaft which said first and second rocker arms are mounted and about which said first and second rocker arms are pivotal;

a hydraulically operated interlocking device which selectively interconnects said first and second rocker arms in a manner wherein relative movement therebetween is prevented;

a pivot at one end of said first rocker arm, said pivot being received in a pivot seat which is adapted for connection with a cylinder head having a supply passage structure through which hydraulic fluid under pressure can be selectively supplied; and passage means for providing fluid communication between the supply passage and said interlocking device, said passage means comprising a first passage formed in said pivot seat and a second passage formed in said pivot.

3. A valve train as claimed in claim 2, wherein said pivot is formed at the end of an adjust screw which is threadedly received in the threaded bore formed in said first rocker arm.

4. A valve train as claimed in claim 3 wherein said pivot has an essentially spherical shape.

5. A valve train as claimed in claim 4 wherein said pivot seat is formed with a recess having an essentially hemi-spherically shaped bottom in which said essentially spherical shaped pivot is received.

6. A valve train as claimed in claim 5 wherein said essentially spherically shaped pivot has a flat formed on the bottom thereof in a manner to define a chamber in the hemi-spherically shaped bottom of said recess, said first and second passages communicating with said chamber.

7. A valve train as claimed in claim 2, further comprising a third rocker arm, said third rocker arm being mounted on said shaft so as to be side by side with said first and second rocker arms and so that said second rocker arm is sandwiched between said first and third rocker arms, said third rocker arm being arranged to engage a second poppet valve and to be motivated by a third cam having a profile suited for low speed engine operation;

a second pivot at the end of said third rocker arm, said second pivot being received in a pivot seat which is adapted for connection with a cylinder head; and wherein said hydraulically operated interlocking device comprises:

a first bore formed in said first rocker arm;

a first plunger reciprocatively disposed in said first bore in a manner to define a hydraulic chamber which is in fluid communication with said second passage;

a second bore formed in said second rocker arm, said second bore being formed in said second rocker arm so as to be alignable with said first bore;

a second plunger reciprocatively disposed in said second bore, said second plunger having first end which is abutable with and end of said first plunger, said second plunger having a length which is essentially the same as the length of the bore;

a third bore formed in said third rocker arm, said third bore being formed in said third rocker arm so as to alignable with said second bore;

a third plunger reciprocatively disposed in said third bore, said third plunger having a first end which is abutable with a second end of said second plunger;

a return spring disposed in said third bore and arranged to produce a bias which acts on a second end of said plunger.

8. A valve train as claimed in claim 2, further comprising a third rocker arm, said third rocker arm being mounted on said shaft so as to be side by side with said first and second rocker arms and so that said first rocker arm is sandwiched between said second and third rocker arms, said third rocker arm arranged to be motivated by a third cam having a profile suited for high speed engine operation; and wherein said hydraulically operated interlocking device comprises:

first and second bores formed in said first rocker arm;

first and second plungers reciprocatively disposed in said first and second bores, respectively, said first and second bores being fluidly communicated with one another in a manner to define hydraulic chamber means which is in fluid communication with said second passage, a pressure in said hydraulic chamber producing a bias which tends to move said first and second plungers in diametrically opposite directions;

a third bore formed in said second rocker arm;

a third plunger reciprocatively disposed in said third bore, said third plunger having a first end which is engageable with an outboard end of said first plunger;

a first return spring disposed in said third bore and arranged to produce a bias which acts on a second end of said third plunger;

a fourth bore formed in said third rocker arm;

a fourth plunger reciprocatively disposed in said fourth bore, said fourth plunger having a first end which is engageable with an outboard end of said second plunger; and a second return spring disposed in said fourth bore and arranged to produce a bias which acts on a second end of said fourth plunger.

* * * * *